United States Patent [19]

Hauser

[11] Patent Number: 4,862,604

[45] Date of Patent: Sep. 5, 1989

[54] COMFORT PAD

[76] Inventor: John P. Hauser, 1160 Bower Hill Rd. Apt 1100B, Pittsburgh, Pa. 15243

[21] Appl. No.: 237,889

[22] Filed: Aug. 29, 1988

[51] Int. Cl.[4] ..... A43B 13/38

[52] U.S. Cl. ..... 36/43; 36/71

[58] Field of Search ..... 36/28, 43, 71, 76 C, 36/88, 93; 128/586

[56] References Cited

U.S. PATENT DOCUMENTS

| | | | |
|---|---|---|---|
| 2,086,999 | 7/1937 | Hack | 36/43 |
| 2,307,416 | 1/1943 | Margolin | 36/43 |
| 2,426,735 | 9/1947 | Hiss | 36/43 |
| 3,265,071 | 8/1966 | Kirchner | 128/586 |
| 4,268,980 | 5/1981 | Gudas | 36/43 |
| 4,317,293 | 3/1982 | Sigle | 36/43 |
| 4,686,993 | 8/1987 | Grumbine | 36/43 |
| 4,776,109 | 10/1988 | Sacre | 36/43 |

*Primary Examiner*—Steven N. Meyers
*Assistant Examiner*—Diana L. Biefeld
*Attorney, Agent, or Firm*—Martin J. Carroll

[57] ABSTRACT

A comfort pad made of resilent and compressible material has a flat bottom surface with a rounded rear end and a relatively straight outer longitudinal side which closely approach the inside rear and outer longitudinal side of the shoe when position therein. The inner longitudinal side is arcuate convex over most of its length with the arcuate convex portion tapering from one surface to the side and being bent upwardly when positioned in the shoe. The pad is substantially shorter than the shoe with the front end being arcuate convex and tapering downwardly and forwardly from the top surface which is generally the same shape as the bottom surface. A depression is provided in the top or bottom surface at the heel portion. The outer longitudinal side extends forwardly a shorter distance than the inner longitudinal side. The top part of the pad adjacent the outer longitudinal side tapers downwardly from adjacent the forward end of the heel portion to the front and also tapers downwardly and outwardly to the outer longitudinal side.

8 Claims, 1 Drawing Sheet

COMFORT PAD

This invention relates to a comfort pad and more particularly to a comfort pad which is readily installed in a shoe and which has some orthopedic function. There are many types of pads on the market but they have various disadvantages. The pad shown in Hauser U.S. Pat. No. 4,442,612 dated Apr. 17, 1984 has been in successful use, but has some disadvantages, two of which are that it must be preformed and it is difficult for an untrained person to fit it in the shoe. Most, if not all, are made in at least part of hard material which will sweat and collect moisture. Except for those which have a flat contour overall they are preformed and in most cases this requires the user to use his foot to make the mold. This of course is very expensive, inconvenient and time consuming. Those made without the users require very skilled workmen to make them. While less expensive and not time consuming, they are still expensive and because of variation in foot shape are not as comfortable or effective as they should be in many cases. PerPedes FuB-Stuzen-GMBH, Wernlinstra Be, P.O. Box 1359 make a pad by the foot-casting method and a cork pad with leather covering of the preformed type. Foot Management, Ames Plaza, R.T. 13, S. Salisburg, Md. 21801 and Berkemann Orthopedics Resources, P.O. Box 513, Bedford Hills, N.Y. 10507; make the preformed type. Scholls of course make many types of pads.

It is therefore an object of my invention to provide a comfort pad which is inexpensive and absorbs moisture.

Another object is to provide such a pad which does not require a specialist to manufacture or install.

Still another object is to provide such a Pad which is formed into the desired shape by the weight of the user when installed in his shoe.

These and other objects will be more apparent after referring to the following specification and attached drawings in which FIG. 1 is a top plan view of a shoe with parts broken away to show the pad of my invention positioned therein;

Figure 1:
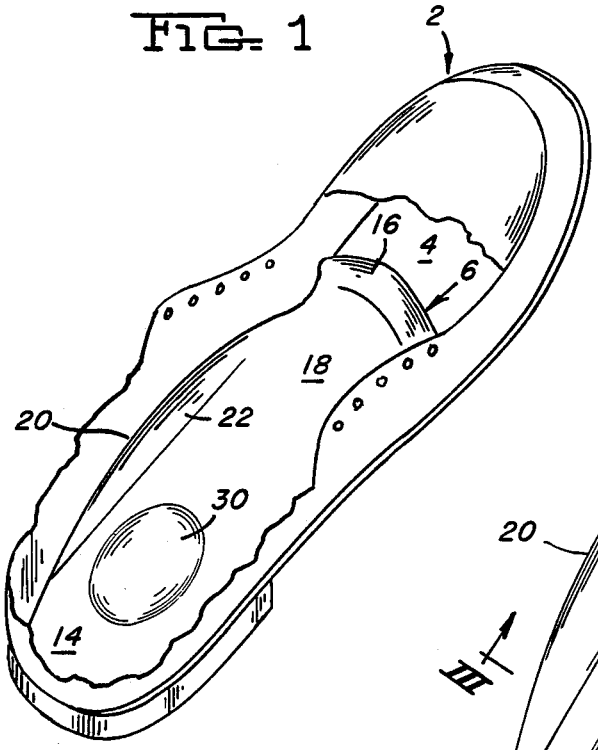
Figure 2:
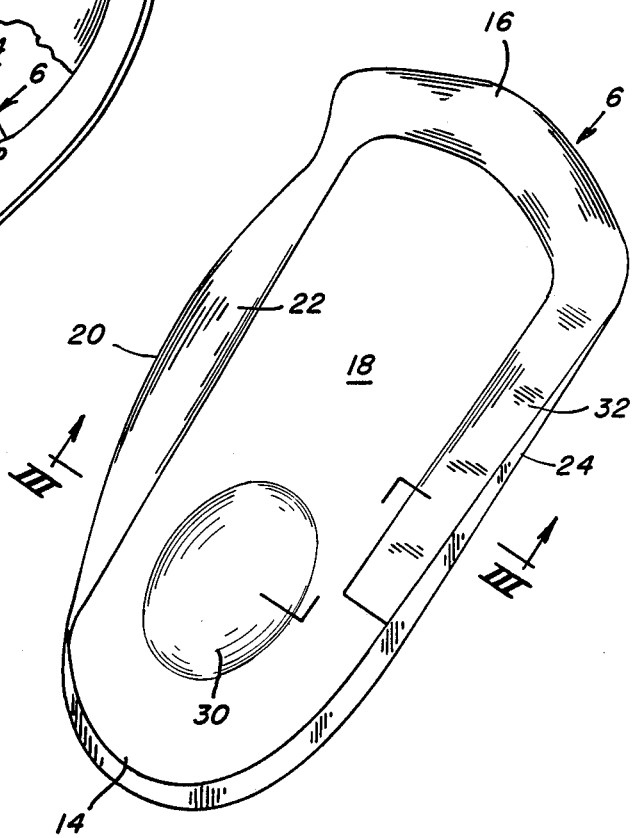
FIG. 2 is a perspective view of the pad of my invention.
Figure 3:
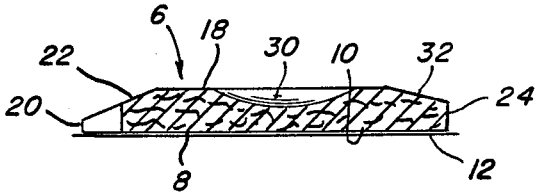
FIG. 3 is a transverse section taken on line III—III of FIG. 2.

Referring more particularly to FIGS. 1 to 3 of the drawings, reference numeral 2 indicates a shoe having an innersole 4 upon which pad 6 of my invention rests. While a right hand shoe and pad are shown it will be understood that a pad of opposite hand will be provided for a left hand shoe.

The Pad 6 has a generally flat bottom surface 8 having a layer of adhesive 10 thereon. A protective strip 12 made of paper, plastic or other suitable material is preferably provided over the adhesive. The rear end 14 of the surface 8 is convex arcuate and of such size and shape that it closely approaches the inside rear contour of the shoe when inserted therein. The rear end is shown as a semi-circle and is usually so formed. The pad 6 does not extend the full length of the shoe, but is no more than three quarters of its length and preferably about two thirds of the shoe length. The forward end 16 of surface 8 is convex arcuate. The Pad 6 has a generally flat top surface 18 of generally the same shape as bottom surface 8. Longitudinal inner side 20 of surface 8 is convex arcuate over most of its length and then extends outwardly to the end 16. The pad adjacent longitudinal side 20 tapers outwardly and downwardly from surface 20 toward surface 8 along a line extending substantially between the ends of the convex arcuate portion so as to provide a tapered section 22.

The width of the pad between the arcuate portion of side 20 and longitudinal outer side 24 is greater than the width of the shoe s that the tapered section 22 will extend up into the inner side of the shoe with the side 24 closely approaching the outer side of the shoe when inserted therein. The side 24 extends forwardly a shorter distance than side 20.

Longitudinal outer side 24 is substantially straight between the front and rear ends. The forward end of the pad conforms to the metatarsal bone structure of the foot and tapers downward from top surface 18 forwardly to bottom surface 8. An egg shaped depression 30 is provided in top surface 18 in the heel section at the location of the calcaneus bone when inserted in the shoe. The top part of the pad 6 tapers from adjacent the forward end of the heel section downwardly approximately to the front end 16 and also tapers downwardly and outwardly to the longitudinal side 24 to provide surface 32.

Pad 6 is made of a compressible and resilient porous material having shock absorbing characteristics such as the wool felt described in U.S. Pat. No. 3,265,071. It is preferably at least 60% wool. One type of material has 65% to 75% new and reprocessed wool and 25 to 35% other fibers such as rayon, cotton and viscus. The thickness may vary but is preferably made of strips no more than ½ inch thick.

In use the pad 6 may be installed in the shoe either with the strip 12 either on or off with the surface 8 downwardly, the longitudinal side 24 along the outside of the shoe, and the rear end 14 adjacent the inside rear of the shoe. By placing the circular part of the pad flush with the back of the shoe no skill is required for correct positioning. The weight of the user causes the pad to conform to the shape which provides best comfort. The depression in the heel section results in less heel elevation with resulting greater comfort. The undercutting along the longitudinal inner or medial side 20 assists formation of the pad to provide scaphoid support for the medial arch. The forward end of the pad gives metatarsal support.

Figure 4:
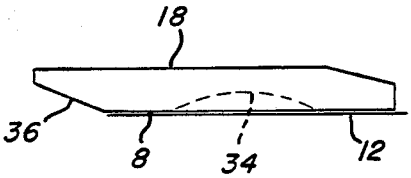
FIG. 4 is a rear end view of a second embodiment of my invention.

In the embodiment shown in FIG. 4 a depression 34 similar to depression 30 is provided in bottom surface 8 in place of depression 30. Also a tapered section 36 tapering upwardly and outwardly is provided in place of tapered section 22.

The pads are made to fit various sizes of shoes in both women & men styles and are easily inserted in the particular size without adjustment. The pad absorbs moisture so that there is little or no sweating. Pads for women shoes are generally thinner than those for men shoes.

While several embodiments have been shown and described it will be evident that other modifications may be made within the scope of the following claims.

I claim:

1. A resilient and compressible one piece pad adapted to be placed in a shoe having a rear end with a heel, a forward end, an outer longitudinal side, an inner longitudinal side and an inner bottom sole; said pad having a rear end with a heel portion, a forward end, an outer longitudinal side, an inner longitudinal side and comprising a substantially flat bottom surface adapted to contact said inner bottom sole, the rear end of said surface being arcuate convex and adapted to closely approach the inside rear of said shoe, the forward end of said surface being arcuate convex, the outer longitudinal side being relatively straight and adapted to closely approach the outer longitudinal side of the shoe, its inner longitudinal side being arcuate convex from adjacent the forward end of said heel portion forwardly for the majority of the pad length and then extending outwardly at an angle to said outer forward end, said outer longitudinal side extending forward a shorter distance than said inner longitudinal side, the top part of said pad adjacent the outer longitudinal side tapering downwardly from adjacent the forward end of said heel portion approximately to the front thereof and also tapering downwardly and outwardly to said outer longitudinal side, an upper surface of generally the same shape as said bottom surface when laid out flat, the width of said pad being wider than said shoe between said outer longitudinal side and the arcuate portion of said inner longitudinal side, said inner longitudinal side adapted to be bent up into the shoe from its flat condition when positioned therein, said pad at its forward end tapering downwardly and forwardly from said top surface.

2. A comfort pad according to claim 1 in which one of said top and bottom surface has a depression in the heel portion thereof at the location of the calcaneas bone when positioned in the shoe.

3. A comfort pad according to claim 2 in which said depression is in the top surface, and said taper adjacent the inner longitudinal side is from the top side downwardly.

4. A comfort pad according to claim 2 in which the length of said pad is no more than three-quarters the length of said shoe.

5. A comfort pad according to claim 2 in which the material of said pad is a felt made of at least 60% wool.

6. A comfort pad according to claim 1 in which the length of said pad is no more than three-quarters the length of said shoe.

7. A comfort pad according to claim 1 in which the material of said pad is a felt made of at least 60% wool.

8. A comfort pad according to claim 1 in which the material of said pad is a felt made of at least 60% wool.

* * * * *